US006237292B1

(12) United States Patent
Hegemier et al.

(10) Patent No.: US 6,237,292 B1
(45) **Date of Patent: *May 29, 2001**

(54) REINFORCEMENT OF CEMENTITIOUS WALLS TO RESIST SEISMIC FORCES

(75) Inventors: Gilbert A. Hegemier, La Jolla; Frieder Seible, Encinitas, both of CA (US)

(73) Assignee: The Regents of the University of California at San Diego, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/395,485

(22) Filed: Sep. 14, 1999

Related U.S. Application Data

(63) Continuation of application No. 08/667,916, filed on Jun. 20, 1996, now Pat. No. 6,003,276.

(51) Int. Cl.[7] ..... E04H 9/02; E04B 2/02

(52) U.S. Cl. ..... 52/273; 52/167.4; 52/236.6; 52/745.05; 156/71; 428/296.1

(58) Field of Search ..... 52/273, 274, 293.1, 52/293.3, 236.6, 745.05, 745.09, 745.1, 167.4, 167.9; 156/71, 92; 428/119, 120, 296.1

(56) References Cited

U.S. PATENT DOCUMENTS

| | | | | |
|---|---|---|---|---|
| 3,616,113 | * | 10/1971 | Sawyer | 52/273 X |
| 4,370,390 | * | 1/1983 | Burk | 428/408 |
| 4,932,171 | * | 6/1990 | Beattie | 52/273 X |
| 5,043,033 | * | 8/1991 | Fyfe | 156/71 |
| 5,425,207 | * | 6/1995 | Shayman | 52/745.08 X |
| 5,607,527 | * | 3/1997 | Isley, Jr. | 156/71 |
| 5,640,825 | * | 6/1997 | Ehsani et al. | 428/408 |

FOREIGN PATENT DOCUMENTS

| | | | | |
|---|---|---|---|---|
| 1509371 | * | 6/1969 | (DE) | 52/273 |

OTHER PUBLICATIONS

University of California, San Diego "The Repair of Reinforced Structural Masonry Walls using a Carbon Fiber, Polymeric Matrix Composite Overlay" by Donato Innamorato, 1994.

P.T. Laursen et al., "Seismic Retrofit and Repair of Reinforced Concrete with Carbon Overlays", Report No. SSRP–95/01, pp. i–192, Jan. 1995.

* cited by examiner

*Primary Examiner*—Carl D. Friedman
*Assistant Examiner*—Winnie Yip
(74) *Attorney, Agent, or Firm*—Knobbe, Martens, Olson & Bear, LLP.

(57) ABSTRACT

A cementitious wall is externally reinforced against out-of-plane or in-plane seismic forces using an overlying layer of composite material, preferably a carbon-fiber/polymer matrix composite material. To externally reinforce the wall against out-of-plane forces, the composite material is applied to the wall as an overlay with the fibers extending vertically. At the base of the wall, the composite overlay is tied to the horizontal building structure using right-angle ties spaced-apart along the foot of the wall. The composite overlay may either be structurally tied to intervening floor structures using right-angle ties, or it may be structurally isolated from the intervening floor structures using flat-tie pass throughs. To externally reinforce the wall against in-plane horizontal forces, the composite material is applied to the wall as an overlay with the fibers running only horizontally.

5 Claims, 8 Drawing Sheets

REINFORCEMENT OF CEMENTITIOUS WALLS TO RESIST SEISMIC FORCES

This application is a continuation of U.S. application Ser. No. 08/667,916 filed Jun. 20, 1996, now U.S. Pat. No. 6,033,276.

This invention was made with Government support under Grant/Contract Number MDA 972-94-3-0030, awarded by the Advanced Research Projects Agency. The Government has certain rights in the invention.

BACKGROUND OF THE INVENTION

This invention relates to the construction of buildings and, more particularly, to the reinforcement of cementitious building walls to resist damage produced by seismically induced forces.

There are thousands of buildings located in the earthquake-prone regions of the world whose cementitious walls are susceptible to seismically induced damage. (As used herein unless otherwise indicated, "cementitious" walls include cement or concrete walls made of either masonry or poured construction, which do or do not contain internal steel reinforcing structure.) During an earthquake, the ground upon which the building rests moves laterally and/or vertically. These ground motions are transmitted through the building foundation and thence into the building walls as force responses. The walls may be cracked as a result of the ground motions or, if the motions are sufficiently severe, the walls may fail completely and collapse.

The ground motions produce force response components in the building wall that lie in the plane of the building wall or out of the plane of the building wall. The nature of the ground motions and force responses at any particular location that might result from an earthquake cannot be predicted with complete certainty. However, in many cases the predominant mode of ground motion and the resulting forces on the walls can be estimated. That is, an engineer who analyzes a building and the geological fault structure in its vicinity can often predict that a wall would likely be subject to particular force components that are out-of-plane, vertical in-plane, and horizontal in-plane, where the "plane" refers to the plane of the wall. The present invention is directed toward reinforcement of cementitious building walls to resist damage induced by such in-plane forces and out-of-plane forces, also termed "flexural" response.

It has been known to externally reinforce building walls to resist damage induced by seismic movements. Studies by the inventors have determined that different modes of seismic forces require different types of external reinforcement for optimal damage resistance, and have further shown that some of the most common modes of external reinforcement may have little beneficial effect in resisting cracking and/or failing of the building walls in many cases. There is, therefore, a need for improved approaches to external reinforcement of cementitious building walls to resist damage caused by various types of force and motion components, which are optimized for particular force responses in the building walls. The present invention fulfills this need, and further provides related advantages.

SUMMARY OF THE INVENTION

The present invention provides an approach to the external reinforcement of cementitious building walls against damage induced by seismic movements, which is tailored to the types of movements and forces expected. The approach is readily applied to both new construction and to the retrofit of existing construction. The technique of the present invention is relatively inexpensive to utilize, as compared with redesign or reworking of the interior structure of the wall. Reinforcement is achieved using materials that are well known in building construction or are known in other industries and can be readily applied to the case of building construction.

In accordance with the invention, a method is provided for externally reinforcing a vertically extending cementitious wall having a base adjacent to a horizontal building structure which extends laterally therefrom, against damage induced by out-of-plane seismic forces. The cementitious wall has a first side and a second side. A base strip of fiber composite material overlies the first side of the cementitious wall at its base. The base strip comprises vertically oriented fibers in a curable matrix. The method further includes providing a right-angle tie having a horizontal leg and a vertical leg, positioning the right-angle tie with the vertical leg contacting the base strip and the horizontal leg resting on the horizontal building structure, and applying an overlay layer of fiber composite material overlying the first side of the wall and the vertical leg of the right-angle tie. The vertical leg is captured between the base strip and a portion of the overlay layer of fiber composite material. The overlay layer of fiber composite material comprises vertically oriented fibers in a curable matrix. Lastly, the horizontal leg of the right-angle tie is fixed to the horizontal building structure.

The composite material used for the base strip and the overlay layer is preferably unidirectional graphite or carbon fibers embedded in a curable matrix, such as an epoxy matrix. Desirably, the wall is reinforced with the same approach on the second side of the wall. The right-angle tie preferably comprises a plurality of discrete right-angle ties arranged in a side-by-side fashion along the base of the wall. The right-angle ties preferably have protruding ears on at least the vertical leg to improve load transfer from the composite overlay.

At locations where there are horizontal building structures, such as a foundation, floor, or roof, extending horizontally from the wall, the loads in the composite overlay may either be passed through the wall structure or tied into it. Wall loads in the composite overlay are typically tied to foundations and roofs, but may be either tied to or passed through floor structures.

In the approach for passing the loads through the horizontal building structure without transferring them into the horizontal building structure, a floor opening is formed through the horizontal building structure at a location adjacent to the cementitious wall. An above-floor base strip of fiber composite material is applied overlying the first side of the cementitious wall immediately above the horizontal building structure, and a below-floor base strip of fiber composite material overlying the first side of the cementitious wall immediately below the horizontal building structure. Both base strips comprise vertically oriented fibers in a curable matrix. The method further includes providing a flat tie, having an above-floor leg and a below-floor leg, and positioning the flat tie through the floor opening with the abovefloor leg contacting and overlying the above-floor base strip and the below-floor leg contacting and overlying the below-floor base strip. The overlay layer of fiber composite material is applied overlying the first side of the wall and the flat tie, so that the flat tie is captured between the base strips and a portion of the overlay layer of fiber composite material. The overlay layer of fiber composite material comprises vertically oriented fibers in a curable matrix.

In another approach for tieing the loads of the composite material overlay into the horizontal building structure, the overlay layer of fiber composite material is applied having a first segment overlying the first side of the wall and a second segment overlying a portion of the horizontal building structure adjacent to the wall. The method includes providing a right-angle tie having a horizontal leg and a vertical leg, positioning the right-angle tie with the vertical leg contacting the first segment and the horizontal leg contacting the second segment, and fixing the horizontal leg of the right-angle tie to the horizontal building structure, through the material of the second segment.

The approach of the invention is also used to externally reinforce a wall against in-plane seismic forces. In accordance with this aspect of the invention, a method for reinforcing a cementitious wall comprises the steps of providing a vertically extending cementitious wall having a first side and a second side, and applying an overlay layer of fiber composite material to the first side of the wall. The overlay layer of fiber composite material comprises horizontally oriented fibers in a curable matrix, there being substantially no non-horizontal external fiber reinforcement. A similar approach may be used on the second side of the wall, but studies have shown that external reinforcement on a single side is substantially as effective as external reinforcement on two sides.

The approach of the invention provides excellent external reinforcement of the wall against force components that lie primarily in the identified directions. The vertically oriented composite material transfers the stresses produced by the out-of-plane flexural forces on the wall into the ties, which deform elastically and then, under extreme loadings, plastically to absorb the energy that otherwise would cause cracking and possible failure of the wall. The horizontally oriented composite material resists horizontal in-plane forces without inducing additional failure modes. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 2A–2D are a pictorial flow diagram, using a perspective view of the wall, of one preferred approach for externally reinforcing a wall against out-of-plane seismic forces, wherein FIG. 2A illustrates the application of the base strip, FIG. 2B illustrates the placement of the right-angle ties, FIG. 2C illustrates the application of the composite overlay, and FIG. 2D illustrates the fixing of the right-angle tie to the horizontal building structure;

FIGS. 3A–3B are sectional views, taken along line 3—3 of FIG. 2D, illustrating the completed external reinforcement, wherein FIG. 3A illustrates bolting into blind holes and FIG. 3B illustrates through-bolting of the horizontal building structure;

FIGS. 5A–5D are a pictorial flow diagram, using a side sectional view of the wall, of another preferred approach for externally reinforcing a wall having a floor structure against out-of-plane seismic forces while passing forces through a horizontal building structure, wherein FIG. 5A illustrates the application of the base strip, FIG. 5B illustrates the placement of the ties, FIG. 5C illustrates the application of the composite overlay, and FIG. 5D illustrates the fixing of the right-angle tie to the horizontal building structure;

FIGS. 6A–6D are a pictorial flow diagram, using a perspective view of the wall, of another preferred approach for externally reinforcing a wall against out-of-plane seismic forces, with simultaneous attachment to a horizontal building structure, wherein FIG. 6A illustrates the application of the base strip, FIG. 6B illustrates the placement of the right-angle tie, FIG. 6C illustrates the application of the composite overlay, and FIG. 6D illustrates the fixing of the right-angle tie to the horizontal building structure;

DETAILED DESCRIPTION OF THE PREFERRED EMBODIMENTS

Figure 1:
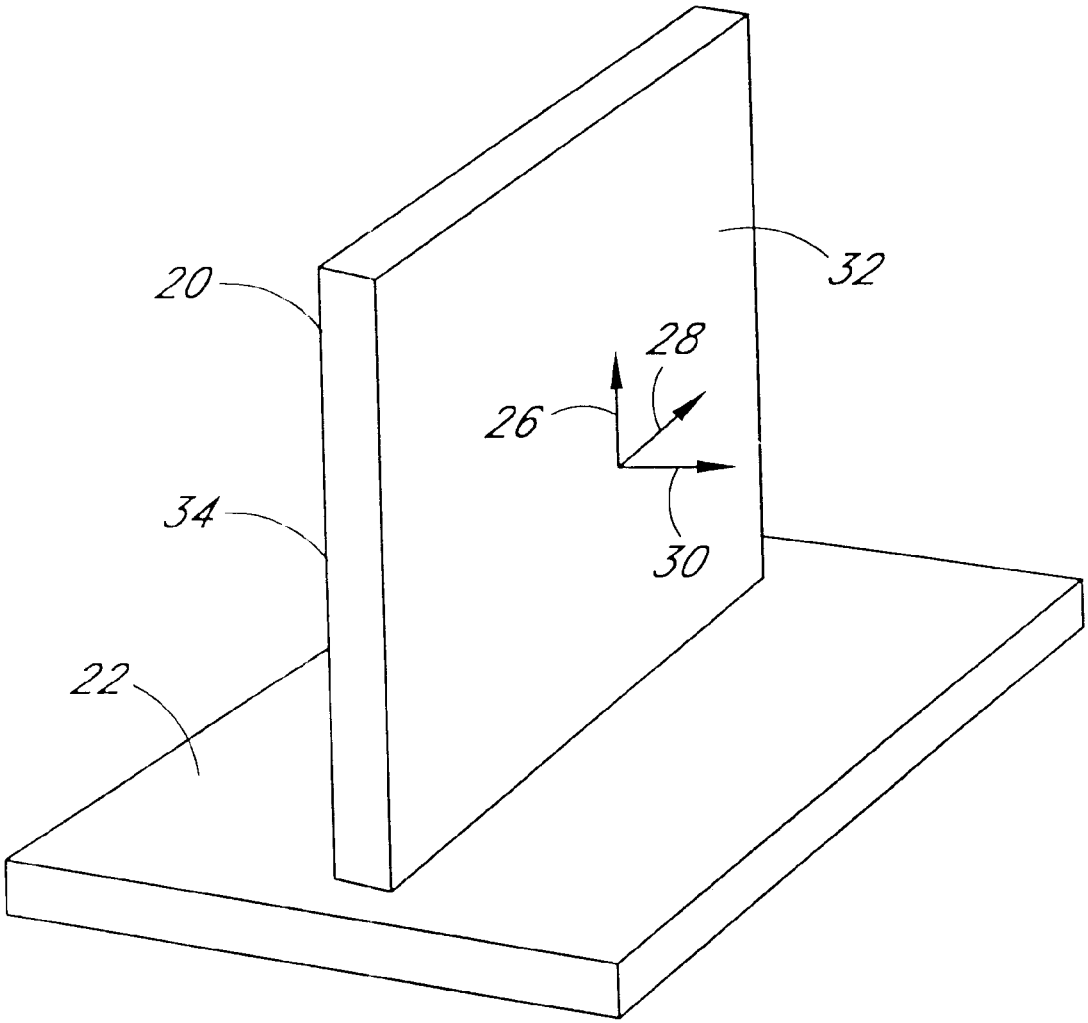
FIG. 1 is a perspective view of a wall.

FIG. 1 illustrates a wall 20 contacting a horizontal building structure 22, which is depicted in FIG. 1 as a foundation but which also may be a laterally continuous floor or a roof (if the view of FIG. 1 is inverted). The wall 20 is at least in part of cementitious construction. As used herein unless otherwise indicated, "cementitious" walls include cement or concrete walls made of either masonry (i.e., blocks joined by mortar) construction or poured construction. "Cement" also includes cement-like materials used to form walls, such as brick, adobe, earth, rock, compositions which are cement-like but may not be within a strict definition of the term cement, and the like. The wall may contain an internal reinforcing structure, or it may have no such internal reinforcement. An internal reinforcement, typically of steel reinforcing bars, is distinct from the external composite material reinforcement provided by the present invention and discussed subsequently. The present invention is not concerned with the internal reinforcement of the walls, but only with external reinforcement which may be applied to the wall when it is first built, or as a retrofit to an existing wall. The wall 20 may be entirely cementitious, as in a cast concrete or concrete block wall, or it may be partly cementitious, as for example in a cementitious surface built over a wooden frame. The internal construction and support of the wall 20 are conventional. The wall 20, which extends generally vertically from the ground, may be characterized by an in-plane vertical direction 26, an in-plane horizontal direction 28, and an out-of-plane horizontal direction 30. The "plane" referenced herein is the plane of the wall containing the axes 26 and 28.

During seismic activity such as an earthquake, the ground moves in one or more of several modes of motion. These ground motions are transmitted into the wall 20 as one or more of several modes of movement and force response: an out-of-plane or flexural mode imparting forces parallel to the direction 30, an in-plane vertical mode which imparts forces in the direction parallel to the direction 26, or an in-plane horizontal mode which imparts forces in the direction indicated by the direction 28. If the amplitude of the forces in any of these modes is sufficiently large, the cementitious material of the wall 20 may crack and, for even larger amplitudes, fail. The present invention is directed toward providing external reinforcement to the wall to resist damage by out-of-plane horizontal forces (direction 30) and in-plane horizontal forces (direction 28).

According to the present invention, the wall 20 is externally reinforced with a fiber composite material on a first side 32, a second side 34, or both. FIGS. 2A–2D illustrate a sequence of externally reinforcing the wall 20 on its first side 32 against damage by out-of-plane horizontal forces, and tieing the forces in the wall to a horizontal building structure. In all of the external reinforcement approaches discussed herein, the side of the wall to which the composite material is to be affixed is first cleaned, filled, and smoothed. The cementitious surface is preferably cleaned by sand or dry-ice blasting. It is thereafter filled and smoothed to produce a flat, continuous surface. Holes or cavities in the wall are filled with a filler/smoother composition that is applied to the wall and smoothed. The filler/smoother composition is preferably a mixture of a standard epoxy, such as one having equal parts of Shell Epon 815 resin and Henkel Versamid 140 hardener, and microspheres and/or fumed silica. The filler/smoother compound is thereafter cured.

Figure 2A:
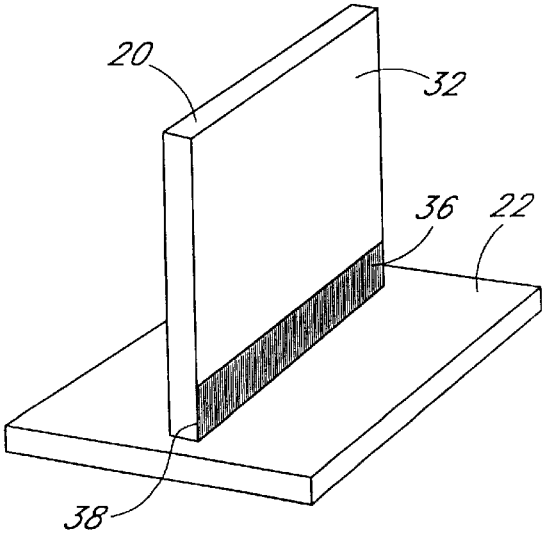

Referring to FIG. 2A, a base strip 36 of fiber composite material is applied to the first side 32 at a base 38 where the wall contacts the horizontal building structure 22. The base strip 36 is made of a composite material of fibers embedded in a curable matrix. In a typical case, the volume fraction of graphite fibers in the composite material is about 60–70 volume percent. The fibers are preferably substantially unidirectional and extending substantially parallel to the in-plane vertical direction 26. In a preferred embodiment, the base strip 36 is 8 inches wide by 0.040 inches thick and is made of a unidirectional carbon cloth of 12k AS4D carbon tows made by Hercules and woven into a cloth by Hexcel. (There may be non-structural fibers in the cloth to hold the unidirectional structural fibers in position, however.)

The carbon cloth may be applied to the wall in any operable manner. For example, the wall may be coated with a curable polymeric resin, preferably a standard two-component epoxy having equal parts of Shell Epon 815 resin and Henkel Versamid 140 hardener. The resin used here is preferably the same as used in the filler/smoother compound. The carbon cloth is placed on top of the polymeric resin, and another layer of the polymeric resin is rolled into the carbon cloth to achieve good wetting of the polymeric resin to the carbon. Additional polymeric resin is added and rolled into place as desired. The polymeric resin is cured in place by the approach recommended by the manufacturer for the matrix resin. In the preferred case, curing is at ambient temperature for several hours, typically at least about 4 hours. Equivalently for the present purposes, the carbon cloth may be impregnated and wetted with the polymeric resin and then applied wet to the wall over a layer of previously applied polymeric resin, and thereafter cured. In another but less preferred approach, the carbon cloth may instead be impregnated with the epoxy and partially cured (i.e., a prepreg material), and thereafter joined to the wall with an adhesive such as the polymeric resin. Any such operable approach is acceptable. The base strip 36 may be made of one or more layers of this cloth. If more than one layer is used, each layer is termed a "ply", and each succeeding layer is fixed in place in the manner described.

In another approach, the curable matrix is a polymer-modified cementitious material. A cementitious material is mixed with from about 2 to about 10 percent by weight of a curable polymer such as an epoxy, a vinyl ester, or a polyester. Sufficient water is present so that the polymer-modified cementitious material has a consistency to permit application by any of the approaches discussed above, or any other operable approach. After the carbon cloth and the polymer-modified cementitious material are applied to the wall, the polymer-modified cementitious material is cured.

Figure 2B:
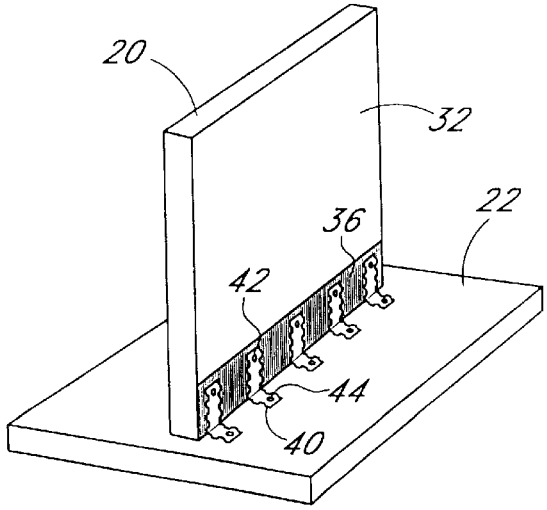
Figure 4:
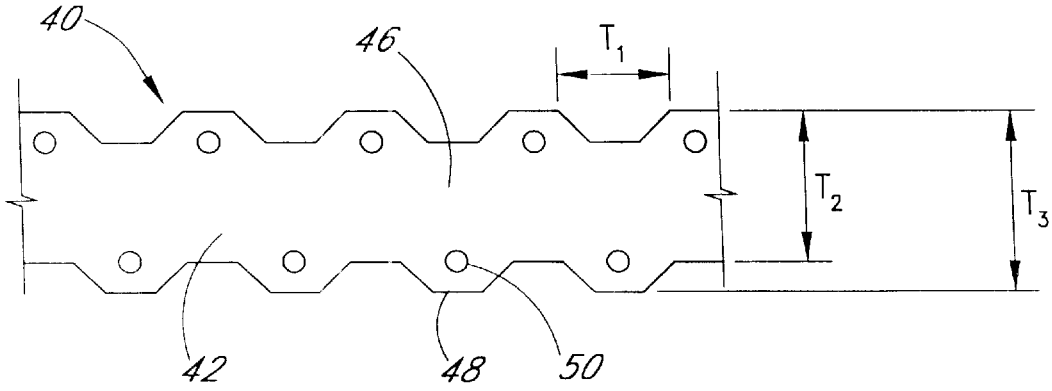
FIG. 4 is a plan view of a vertical leg of a preferred tie.

After the base strip 36 is applied and cured, a right-angle tie 40 having a vertical leg 42 and a horizontal leg 44 is positioned with the vertical leg 42 contacting the base strip 36 and the horizontal leg 44 contacting the horizontal building structure 22. Preferably, the tie 40 is provided as a plurality of discrete ties, as shown in FIG. 2B. The vertical leg 42 of the preferred tie 40 is illustrated in FIG. 4. The tie 40 has a tie body 46 with ears 48 protruding from the lateral sides of the tie body 46 and openings 50 therethrough. The ears 48 provide shear regions to promote load transfer with the composite material to which the tie 40 is subsequently affixed, and the openings 50 provide a locking engagement or keying action with the composite material. A preferred such tie 40 is available commercially as a Simpson Strong-Tie, model ST6236. In this preferred tie, the ears and openings are present for other reasons—to promote nailing of the tie to an underlying structure. In this case, the ears and Simpson-configuration tie are selected to achieve good shear-transfer bonding to underlying and overlying composite material layers. The preferred Simpson tie is made of steel having a minimum yield strength of 37,000 psi (pounds per square inch) and an ultimate strength of 42,000 psi. The right-angle tie has a thickness of 0.08 inches, a length of the vertical leg 42 of 6 inches, and a length of the horizontal leg 44 of 4 inches. This preferred tie has dimensions $T_1$ of 1.25 inches, $T_2$ of 1.75 inches, and $T_3$ of 2.0 inches. The ties 40 are spaced along the base of wall on 4 inch centers.

The illustrated tie and application approach are preferred. The discrete tie of FIG. 2B may also be made with straight, parallel lateral sides and without the openings therethrough. In another approach, the tie of FIG. 2B may be made of a single long right-angle structural angle shape. (The use of such an angle shape is discussed in greater detail subsequently in relation to FIGS. 6A–6D.) These configurations are less preferred than the Simpson tie for the present application.

Figure 2C:
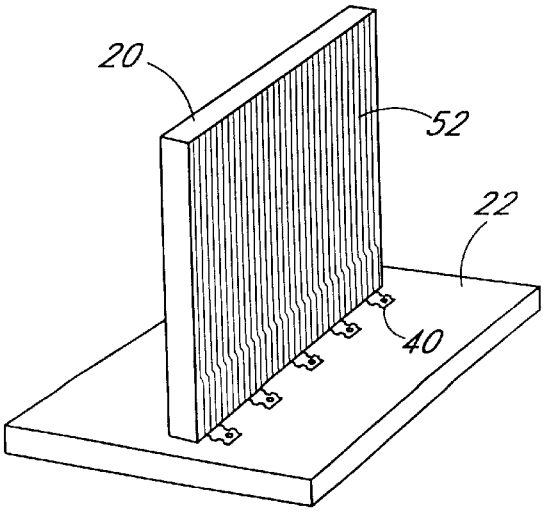

An overlay layer 52 of a fiber composite material is applied to the first side 32 of the wall 20, FIG. 2C. The overlay layer 52 covers the face of the wall and also overlies the base strip 36 and the vertical legs 42 of the ties 40. The vertical legs 42 of the ties 40 are thereby captured between and sandwiched between the base strip 36 and the overlay layer 52. The fiber composite material is preferably the same as that used for the base strip 36 and is applied in the same thickness as the base strip 36. The overlay layer 52 is applied in the same manner as the base strip 36, with the fibers of the overlay layer 52 extending substantially vertically, by any operable application technique, and thereafter cured.

Figure 2D:
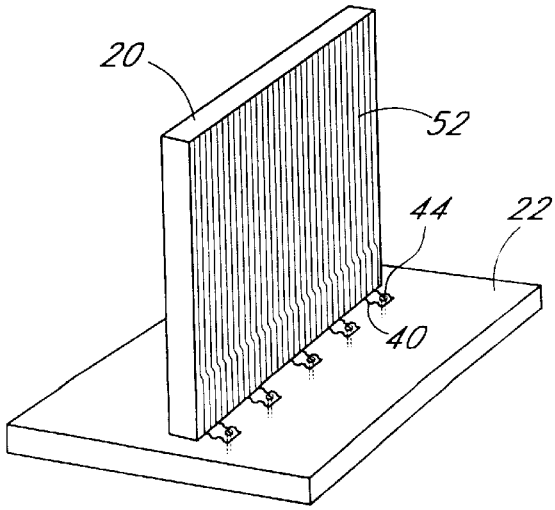
Figure 3A:
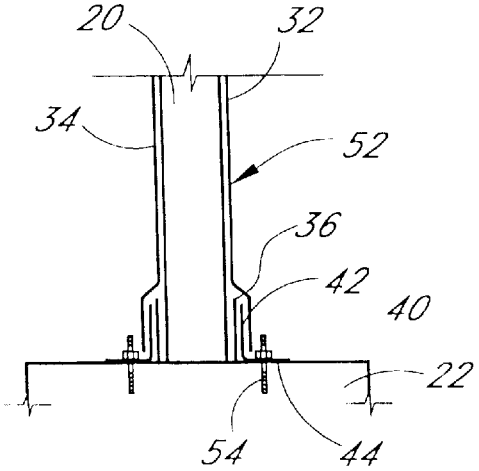
Figure 3B:
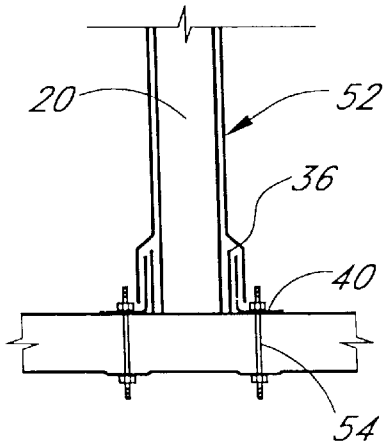

After the overlay layer 52 is cured, the horizontal legs 44 of the ties 40 are affixed to the horizontal building structure 22, preferably by bolting as shown in FIG. 2D. FIGS. 3A and 3B illustrate in sectional view an externally reinforced wall 20 with external reinforcement on both the first side 32 and the second side 34. (External reinforcement of the second side 34 is accomplished by the same approach as described for the first side 32.) The sandwiching of the vertical leg 42 of the tie 40 between the base strip 36 and the overlay layer 52 is visible in these figures. The horizontal leg 44 is bolted to the horizontal building structure 22 by a bolt 54 extending into either a blind hole if only one side of the horizontal building structure is accessible (FIG. 3A), or extending into a through hole if the other side of the horizontal building structure is also accessible (FIG. 3B). The bolt holes for the bolts 54 are centered in the horizontal leg. In a preferred approach, the bolts 54 are threaded ⅜ inch grade 105 steel rod at least about 10 inches long. They are installed with washers and nuts, and with the hole in the horizontal building structure filled with an epoxy such as Sikadur 32 high-mod epoxy. The nuts on the bolts 54 are preferably tightened to a loading of about 30,000 psi tension.

In service, the composite material layers 36 and 52 have two functions. They transfer the stresses produced by the out-of-plane (direction 30) flexural force on the wall into the ties, which first deform elastically and then, under extreme loadings, plastically to absorb the energy that otherwise would cause cracking and possible failure of the wall. The use of layers 36 and 52 with vertically extending fibers is a key consideration in achieving this energy transfer. Horizontally extending fibers would not achieve this load transfer, and angled fibers positioned at an angle to the vertical direction would be less efficient in load transfer and could also induce new failure modes near the base of the wall. Additionally, the overlay layer 52 prevents the spalling away of the cementitious material of the wall during seismic events, a common mode of failure, thereby retaining the structure and functioning of the wall and its interior reinforcement, and also preventing injury to nearby persons by falling debris.

As illustrated in FIGS. 5A–5D, many cementitious walls 20 have interior floor structures 60 lying in the horizontal plane and extending laterally from the wall 20. In some design approaches for seismic resistance, the wall is desirably externally reinforced against out-of-plane horizontal forces without tieing the structural external reinforcement loads to the floor structure 60, and in other cases the external reinforcement loads are tied to the floor structure 60. FIGS. 5A–5D illustrate a preferred approach for externally reinforcing the wall 20 on both sides, while not tieing the loads to the floor structure 60. The same approach as discussed in relation to FIGS. 2A–2D is used to tie the wall 20 to the foundation, and that discussion is incorporated here.

Figure 5A:
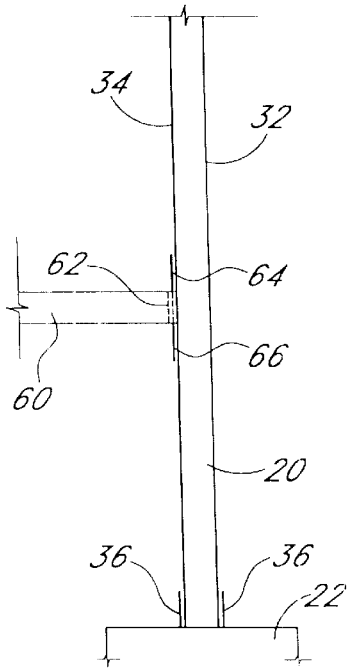
Figure 5B:
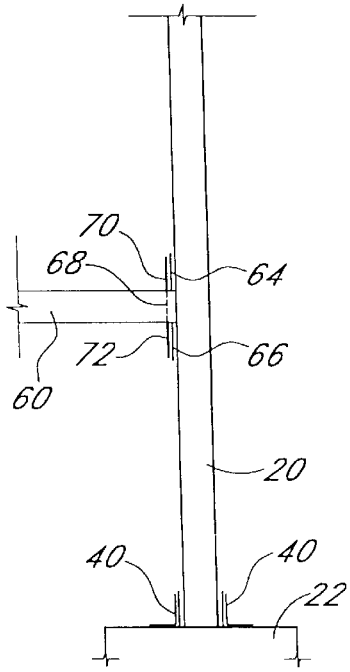

To reinforce the second (interior) side 34 of the wall 20 in the region of the floor structure 60, a plurality of openings 62 are cut through the floor structure 40 near the location where the floor structure 60 joins to the wall 20, FIG. 5A. The openings are typically cut through the sub-flooring material but not through the floor joists, so that the structure of the floor is not weakened. The openings 62 are sufficiently wide, on the order of about 0.100 inch, and sufficiently long, on the order of about 2¼ inches, to receive a tie therethrough. The openings are spaced to define tie positions.

An above-floor base strip 64 and a below-floor base strip 66 of composite material are affixed to the second side 34 of the wall 20, FIG. 5A. The base strips 64 and 66 are preferably made of the same material as the base strip 36 and applied in the same manner, with the fibers unidirectional and extending vertically. A plurality of flat ties 68 are placed through the plurality of openings 62 so as to have an above-floor leg 70 of each tie 68 in facing relationship to the above-floor base strip 64 and a below-floor leg 72 of each tie 68 in facing relationship to the below-floor base strip 66, FIG. 5B. The flat tie 68 preferably has the same structure as the right-angle tie 40, except that it is flat rather than right-angled.

Figure 5C:
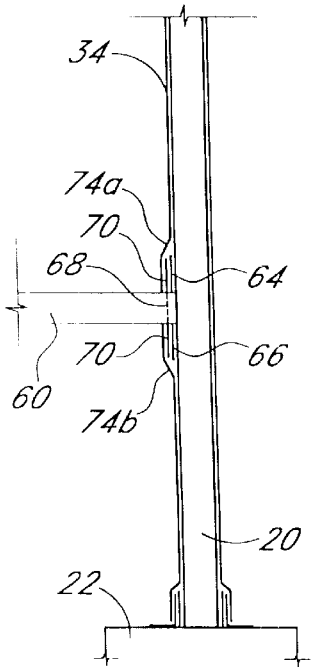

An above-floor overlay layer 74*a* is applied to the second side 34 of the wall 20 above the floor structure 60, and a below-floor overlay layer 74*b* is applied to the second side 34 of the wall 20 below the floor structure 60, FIG. 5C. The overlay layers 74*a* and 74*b* are applied such that they overlie, and are bonded to, the wall surface, the respective base strip 64 or 66, with the above-floor leg 70 sandwiched between the layers 74*a* and 64 and the below-floor leg 72 sandwiched between the layers 74*b* and 66. (On this second, inside, side of the wall 20, the layers 74*a* and 74*b* act as the overlay layer 52 discussed previously.) The material of the overlay layers 74*a* and 74*b* and the approach for affixing the overlay layers to the ties 68 are as described previously in relation to FIGS. 2A–2D. Specifically, the fibers of the overlay layers 74*a* and 74*b* extend substantially vertically on the wall 20.

Figure 5D:
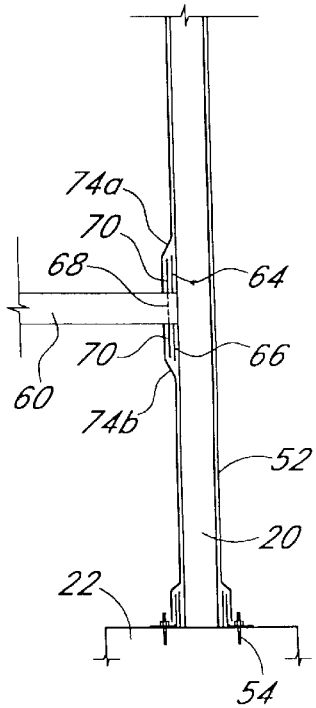

FIG. 5D illustrates the finished installation. The procedure may be extended as necessary for buildings with multiple floors. With this approach, the wall 20 is externally reinforced both inside and outside without transferring a significant amount of the flexing loads produced by out-of-plane seismic forces to the floor structure 60.

In other cases, it is preferred to structurally tie the wall reinforcement to the horizontal building structure, and FIGS. 6A–6D illustrate another preferred approach for the case of a vertically discontinuous wall 80 intersecting a floor. The wall 80 is positioned against a transversely continuous horizontal building structure 82. (This structure is distinct from that of FIGS. 5A–5D, wherein the wall is vertically continuous and the horizontal building structure is built outwardly from the vertically continuous wall.) To reinforce the wall 80 and tie the reinforcement loads to the floor structure 82, an overlay layer 84 of the fiber composite material is applied to a first side 86 of the wall 80, FIG. 5A. The overlay layer 84 is preferably the same material as the overlay layer 52 discussed in relation to FIGS. 2A–2D and is applied in the same manner. The overlay layer 84 has a first segment 84*a* that is affixed to the wall 80 and a second segment 84*b* that, after bending the sheet of overlay material 84 to a right angle, overlies a portion of the floor structure 82 adjacent to the foot of the wall 80. The second segment 84*b* desirably extends outwardly from the wall a distance of at least about 5 inches.

Figure 6A:
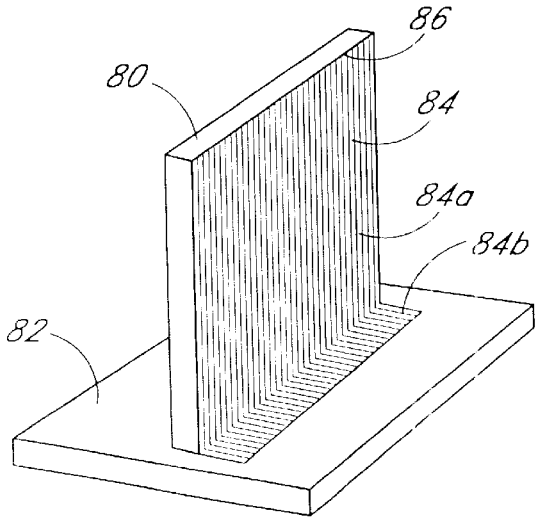
Figure 6B:
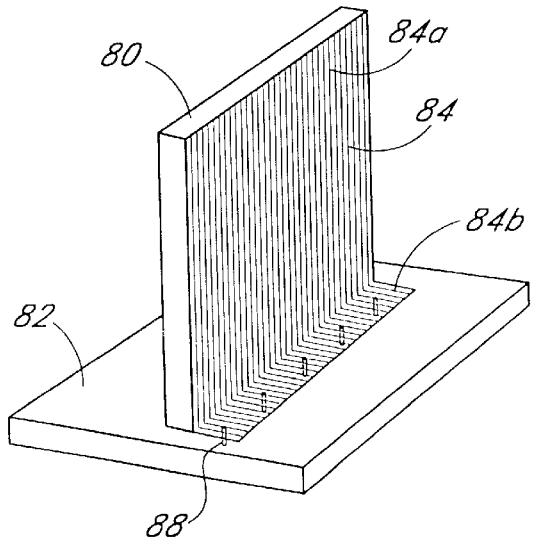
Figure 6C:
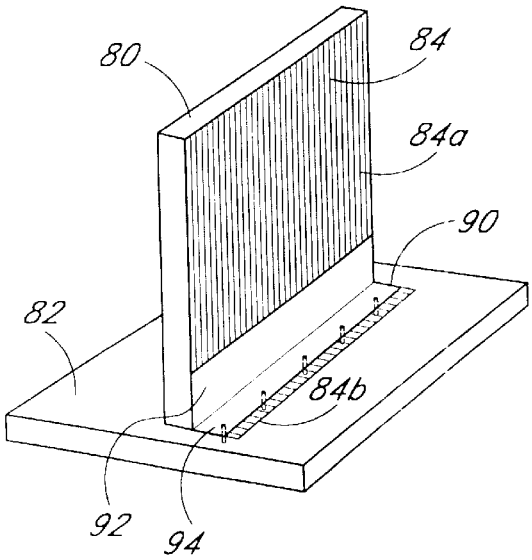
Figure 6D:
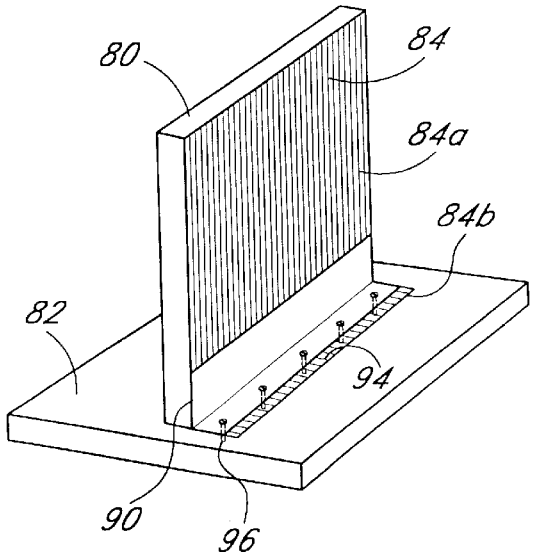

Holes 88 are drilled downwardly through the segment 84*b* into the floor structure 82, FIG. 6B. A right-angle tie 90 is positioned with a vertical leg 92 overlying the lowermost portion of the first segment 84*a* of the overlay layer 84, and a horizontal leg 94 overlying the second segment 84*b* of the overlay layer 84, FIG. 6C. The tie 90 may be a single continuous L-shaped right-angle tie, as illustrated, or it may be a plurality of discrete ties as discussed in relation to FIGS. 2A–2D. For the preferred case, each of the legs 92 and 94 of the tie is about 3 inches long, and the tie is otherwise made of the same material as the tie 40 discussed previously or another steel. Bolts 96 are affixed through the horizontal leg 94 of the tie 90 into the openings 88 of the floor structure 82, using either the blind hole or through-hole approaches discussed in relation to FIGS. 3A and 3B.

With this approach, stresses resulting from out-of-plane flexing movements of the wall 80 are reacted through the tie 90 into the floor structure 82.

The approaches of FIGS. 2–6 relate to those situations in which the predominant seismic force component is expected to be in the out-of-plane direction 30. A different approach is used when the predominant force component is expected to be in the in-plane horizontal direction 28.

Figure 7:
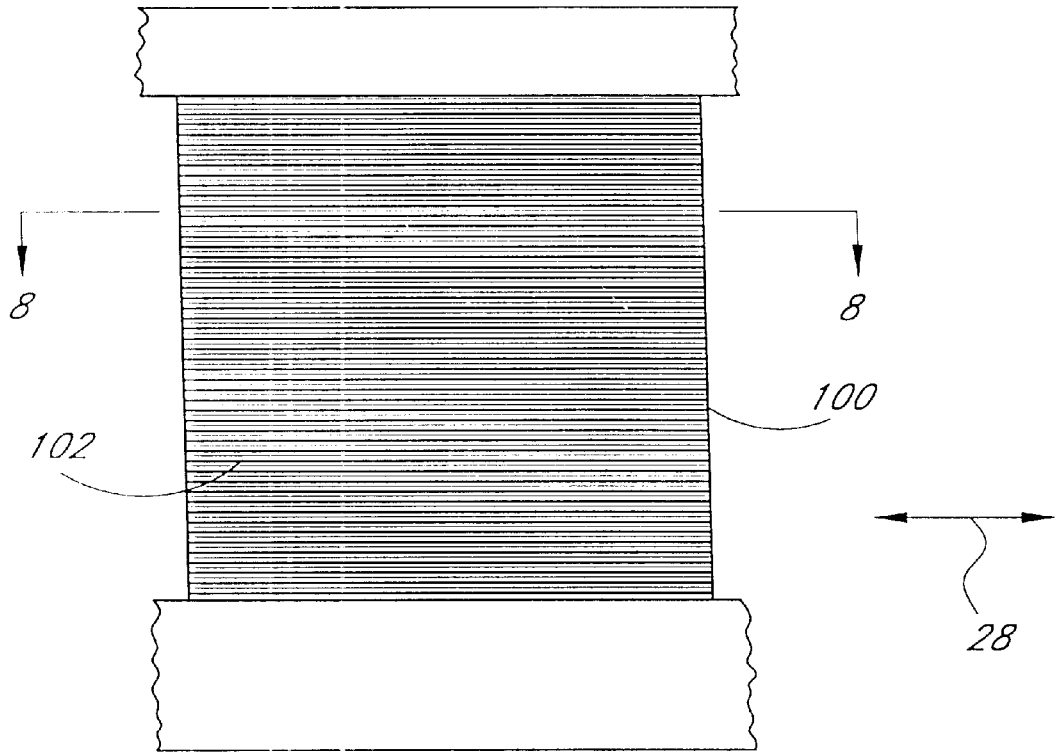
FIG. 7 is a front elevational view of a wall externally reinforced against in-plane seismic motions.
Figure 8:
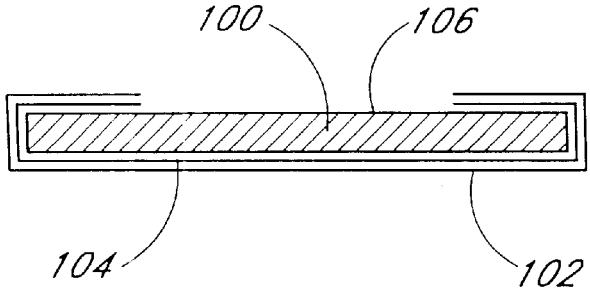
FIG. 8 is a sectional view of the wall of FIG. 7, taken along lines 8—8.

FIGS. 7 and 8 illustrate a wall 100 with an overlay layer 102 of fiber composite material thereon. The fiber composite material is applied only to a first side 104 of the wall 100. If a second side 106 of the wall is accessible, the fiber composite material 102 may be wrapped around the ends and terminated at the ends of the second side, as shown in FIG. 8. Complete coverage of the second side 106 with the layer 102 of composite material is not required but may be utilized. If the second side is covered with a second layer of the composite material, the same approach as used for the first side is used for the second side. However, studies and experiments by the inventors have determined that this one-side external reinforcement against in-plane horizontal movements is substantially of the same effectiveness as two-sided external reinforcement.

The fiber composite material of the overlay layer 102 is preferably substantially the same unidirectional-fiber composite material as described previously for the overlay layer 52. The preferred carbon fiber fabric is Hexcel unidirectional carbon fiber fabric XC1564, which utilizes 12k AS4D tows of unidirectional carbon fiber woven together with low strength polyester fabric transverse to the direction of the carbon fibers. The polyester fabric is present only to hold the carbon fibers together in a cloth and has substantially no strength, so that the carbon fiber fabric is substantially unidirectional in strength in the direction parallel to the carbon fibers. The application approach is similar. The wall is first cleaned and filled/smoothed, as described previously. The same techniques may be used to apply the fiber composite material to the wall. The difference in its application, however, is that the carbon fibers of the overlay layer 102 extend horizontally, parallel to the in-plane horizontal direction 28. In the approach of FIGS. 2–6, the carbon fibers extend vertically.

That the fibers of the layer 102 extend horizontally rather than vertically or at some other angle(s) is a key to the success of the present approach to resisting in-plane seismic forces. This arrangement delays and inhibits the formation of diagonal cracks in the cementitious material. Horizontal cracks, also termed flexural cracks, are allowed to form so that the vertical steel reinforcement within the interior of the wall functions properly. There are plastic zones within the vertical steel internal reinforcement which are distributed over the wall, leading to ductile wall performance. In contrast, if non-horizontal external reinforcing fibers are used, such as the conventional ±45° reinforcement strategy, the plastic zones in the internal steel reinforcement are typically confined to narrow regions adjacent to the bottom and/or the top of the wall, which, in turn, leads to a brittle response.

The present approach for externally reinforcing walls against out-of-plane (FIGS. 2–6) and in-plane (FIGS. 7–8) seismic forces may be applied to new walls, existing and undamaged walls, or walls that have previously sustained relatively minor prior damage. After application of the composite materials and ties, where required, the externally reinforced wall is more resistant to subsequent damage by seismic forces.

Figure 9:
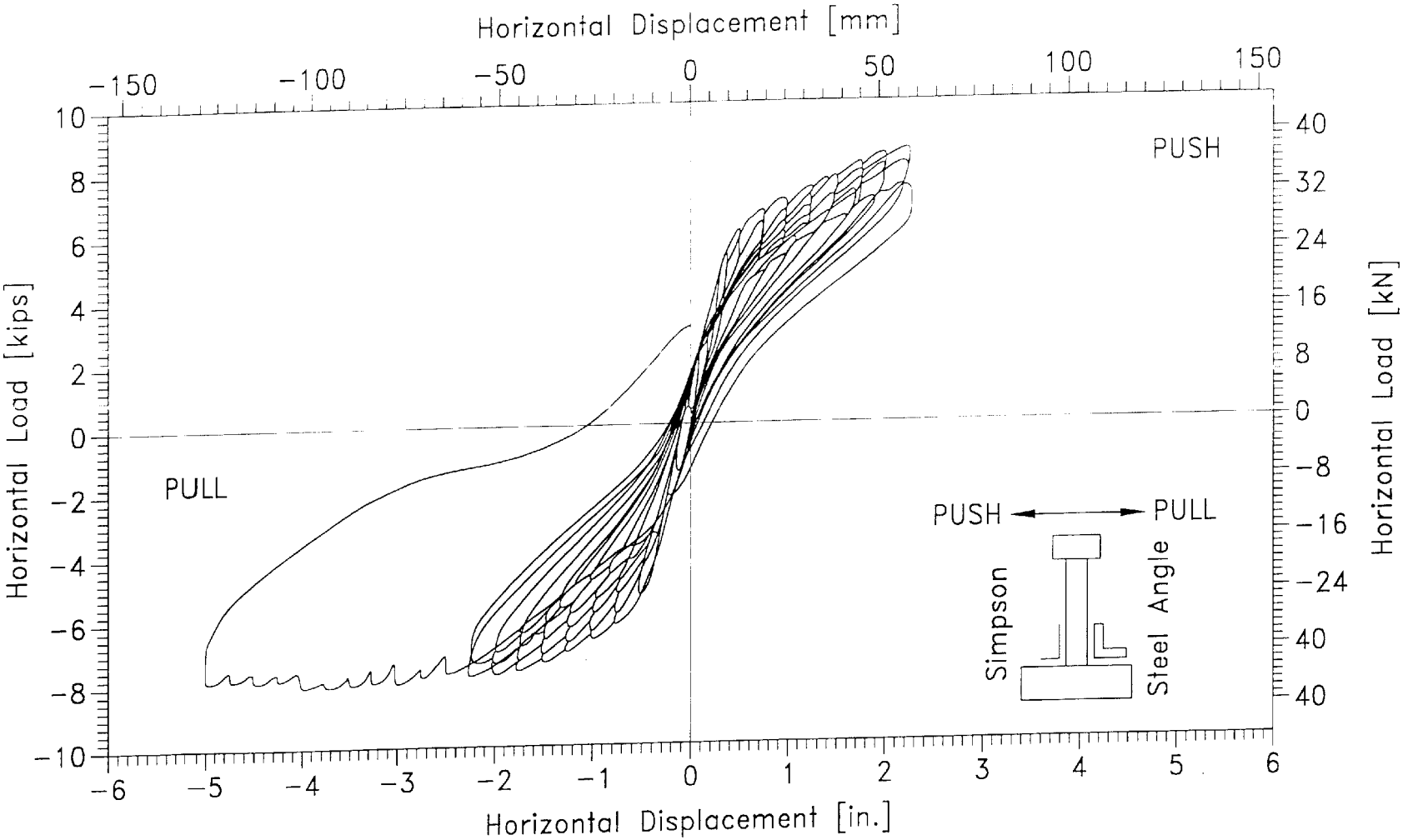
FIG. 9 is a graph of load and displacement for a wall displaced by an out-of-plane displacement.

Full-size walls were constructed and tested according to the present approach. A full-size wall, having no internal steel reinforcement, was constructed using the approach of FIGS. 2A–2D and tested with out-of-plane motions and forces. In order to evaluate different tie techniques, the bottom of one side was tied to the foundation with a preferred Simpson tie, and the other side was tied to the foundation with a continuous steel angle. FIG. 9 illustrates the results. The approach using a Simpson steel tie gave extraordinary performance, as shown by the large plastic deformation during the "pull" portion of the cycle. The large plastic deformation indicates that the tie is absorbing the energy of the out-of-plane motion, permitting the wall to continue to function without failure. The approach using a continuous steel angle was operable and give good results (the "push" portion of the cycle), but not as good as those for the Simpson steel tie.

These results illustrate the different results obtained for discrete ties of the Simpson tie style (as shown in FIGS. 2A–2D) and for continuous ties of the steel angle style (as shown in FIGS. 6A–6D). The continuous ties elastically load the vertically oriented carbon fibers to a higher fraction of their ultimate strength as compared with the Simpson ties. The Simpson ties, on the other hand, absorb more energy than the continuous ties during the application of extremely large movements and forces, because they elongate when subjected to high plastic strains, as compared with the continuous ties which tend to bend rather than elongate. Both types of results are highly advantageous for the reinforcement of cementitious walls. The availability of these two distinct capabilities allows the response of a wall to seismic motions and forces to be tailored with respect to the remainder of the structure and the desired results to be obtained. For example, selected combinations of discrete ties of the Simpson type and relatively long angles may be used on a single wall.

Figure 10:
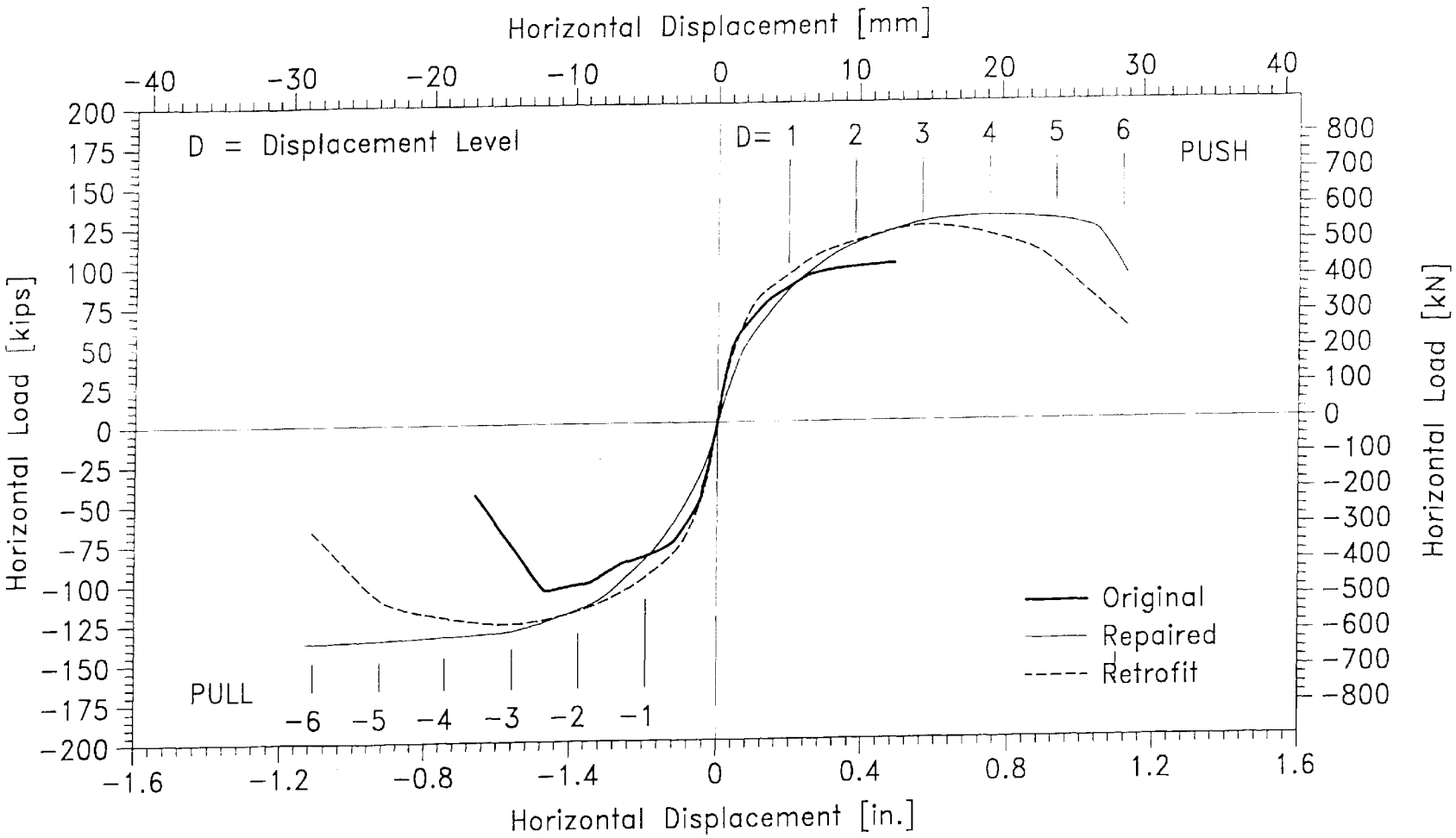
FIG. 10 is a graph of load and displacement for walls displayed by an in-plane displacement.

FIG. 10 depicts test results for three walls that were tested with motion applied in the in-plane horizontal direction 28 (i.e., parallel to the reinforcing fibers where present). A first wall (marked "original") had no reinforcement. It failed at relatively low strains in both push and pull loading. A second wall (marked "repaired") was the first wall which had been first damaged and then repaired using the approach of FIGS. 7–8, except that external reinforcement was applied on both sides of the wall. A third wall (marked "retrofit") was like the first wall, but it was externally reinforcement retrofitted prior to testing with the one-sided approach of FIG. 7. The repaired and retrofitted walls both performed in a similar manner, with both walls performing in a manner superior to that of the unreinforced original wall.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An externally reinforced cementitious wall, comprising:

a substantially vertically extending cementitious wall having at least one accessible substantially planar wall surface and a floor structure extending substantially horizontally from at least a first side thereof;

a base strip of fiber composite material overlying the wall surface substantially immediately above the floor structure, the base strip comprising substantially vertically oriented fibers in a curable matrix;

a base connector having a first leg and a second leg, the base connector being positioned with the first leg contacting and overlying the base strip and the second leg contacting and being secured to the floor structure; and an overlay layer of fiber composite material overlying the wall surface and first leg of the base connector immediately above the floor structure, such that the connector is captured between the base strip and a portion of the overlay layer of fiber composite material, the overlay layer of fiber composite material comprising substantially vertically oriented fibers in a curable matrix.

2. The wall of claim 1 further comprising a second base strip of fiber composite material overlying the wall surface substantially immediately below the floor structure, the base strip comprising substantially vertically oriented fibers in a curable matrix.

3. The wall of claim 1 wherein the overlay layer of fiber composite material comprises a fiber composite material in a curable matrix and a plurality of fibers embedded in the curable matrix, the fibers being selected from the group consisting of graphite fibers and carbon fibers.

4. The wall of claim 1 further comprising a second overlay layer of fiber composite material applied to a second side of the wall, the second overlay layer of fiber composite material comprising horizontally oriented fibers in a curable matrix, there being substantially no non-horizontal fibers in the second overlay layer of fiber composite material.

5. The wall of claim 1 wherein the overlay layer applied to the first side of the wall is substantially planar conforming to said wall surface.

* * * * *